US006205794B1

(12) United States Patent
Brothers

(10) Patent No.: US 6,205,794 B1
(45) Date of Patent: Mar. 27, 2001

(54) CRYOGENIC STORAGE DEVICE

(76) Inventor: John G. Brothers, 18201 Fox Pointe, Clinton Township, MI (US) 48038

( * ) Notice: Subject to any disclaimer, the term of this patent is extended or adjusted under 35 U.S.C. 154(b) by 0 days.

(21) Appl. No.: 09/366,063

(22) Filed: Aug. 2, 1999

(51) Int. Cl.[7] ..... F25B 19/00
(52) U.S. Cl. ..... 62/51.1; 62/457.9
(58) Field of Search ..... 62/51.1, 78, 457.9

(56) References Cited

U.S. PATENT DOCUMENTS 3,007,319 * 11/1961 Ogden ..... 62/64
3,092,974 * 6/1963 Haumann et al. ..... 62/62
4,054,037 * 10/1977 Yoder ..... 62/457.1
4,578,963 * 4/1986 Sitte ..... 62/51.1
4,640,099 * 2/1987 Gibot ..... 62/62
4,739,622 * 4/1988 Smith ..... 62/78
4,958,498 9/1990 Brothers ..... 62/51.1
4,976,112 * 12/1990 Roberts et al. ..... 62/457.9

* cited by examiner

*Primary Examiner*—Ronald Capossela
(74) *Attorney, Agent, or Firm*—Gifford, Krass, Groh, Sprinkle, Anderson & Citkowski, P.C.

(57) ABSTRACT

A cryogenic storage device is disclosed having a tank with an open top and a wall which defines an interior chamber adapted to receive biological specimens. A fluid reservoir is disposed around at least a portion of the wall on an outer surface of the wall and this fluid reservoir receives a liquefied gaseous material, such as liquid nitrogen. The source of the liquid gaseous material is fluidly connected through a valve to the reservoir to maintain the level of the liquefied gaseous material between preset limits in the reservoir thus cooling the interior of the interior chamber and any biological specimens contained within the interior of the chamber.

10 Claims, 2 Drawing Sheets

CRYOGENIC STORAGE DEVICE

BACKGROUND OF THE INVENTION

I. Field of the Invention

The present invention relates generally to cryogenic storage devices and, more particularly, to a cryogenic tank adapted to receive biological specimens.

II. Description of the Prior Art

There are many previously known cryogenic storage tanks which are generally cylindrical in shape and have a closed bottom and open top thus defining a cryogenic freezing chamber. A source of liquefied gaseous material, typically liquid nitrogen, is fluidly connected to the interior of the chamber through a valve system so that the liquid level with the cryogenic chamber is maintained within predetermined limits. A lid is also conventionally disposed across the open top of the cryogenic tank.

In use, frozen biological specimens, such as blood, semen or other types of biological specimens, are simply immersed in the liquid contained within the cryogenic chamber thus storing the biological materials in the desired fashion. Since the temperature of the liquefied gaseous material is extremely low, e.g. below −191° C., the viability of the biological specimens can be maintained for long periods of time.

One disadvantage of these previously known cryogenic storage devices, however, is that, since the biological specimens are immersed within the liquefied gaseous material, cross contamination between the biological specimens is possible. For example, in the event that a biological specimen leaks into the liquefied gaseous material, any impurities, diseases, viruses or the like contained within that biological specimen may thereafter be transmitted to a different biological specimen also contained within the cryogenic freezing tank by using the liquefied gaseous material within the tank as the transportation mechanism for such undesirable contaminants.

SUMMARY OF THE PRESENT INVENTION

The present invention provides a cryogenic device which overcomes all of the above-mentioned disadvantages of the previously known devices.

In brief, the cryogenic storage device of the present invention comprises a tank having an open top and a wall which defines an interior chamber adapted to receive biological specimens. Preferably, the wall is generally cylindrical in shape and closed at its lower end.

A fluid reservoir is disposed around at least a portion of the wall on an outer surface of the wall. This reservoir is adapted to receive a liquefied gaseous material, such as liquid nitrogen. At least one, and preferably several, circumferentially spaced vents are provided on the interior of the wall so that the vents permit vapor from the liquefied gaseous material contained within the reservoir to escape the reservoir.

A source of the liquefied gaseous material, such as liquid nitrogen, is fluidly connected to the reservoir by a valve system which maintains the level of the liquefied gaseous material in the reservoir within predetermined limits. Thus, when the level of the liquefied gaseous material falls below the lower limit, the valve opens and fluidly connects the liquefied gaseous material from the source to the reservoir thus moving the liquid level in the reservoir towards its upper limit. In doing so, the liquefied gaseous material contained in the reservoir cools the interior chamber of the tank in which the biological specimens are contained.

In practice, it has been found that, while using liquefied nitrogen, the temperature of the interior chamber of the tank can be maintained below −140° C., i.e. the temperature necessary to maintain the viability of biological specimens within the tank. In practice, the actual temperature of the tank can be maintained at a temperature less than −190° C.

Since only gas, rather than liquefied gaseous material, is contained within the interior chamber of the tank, cross contamination of the biological specimens is rendered virtually impossible.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
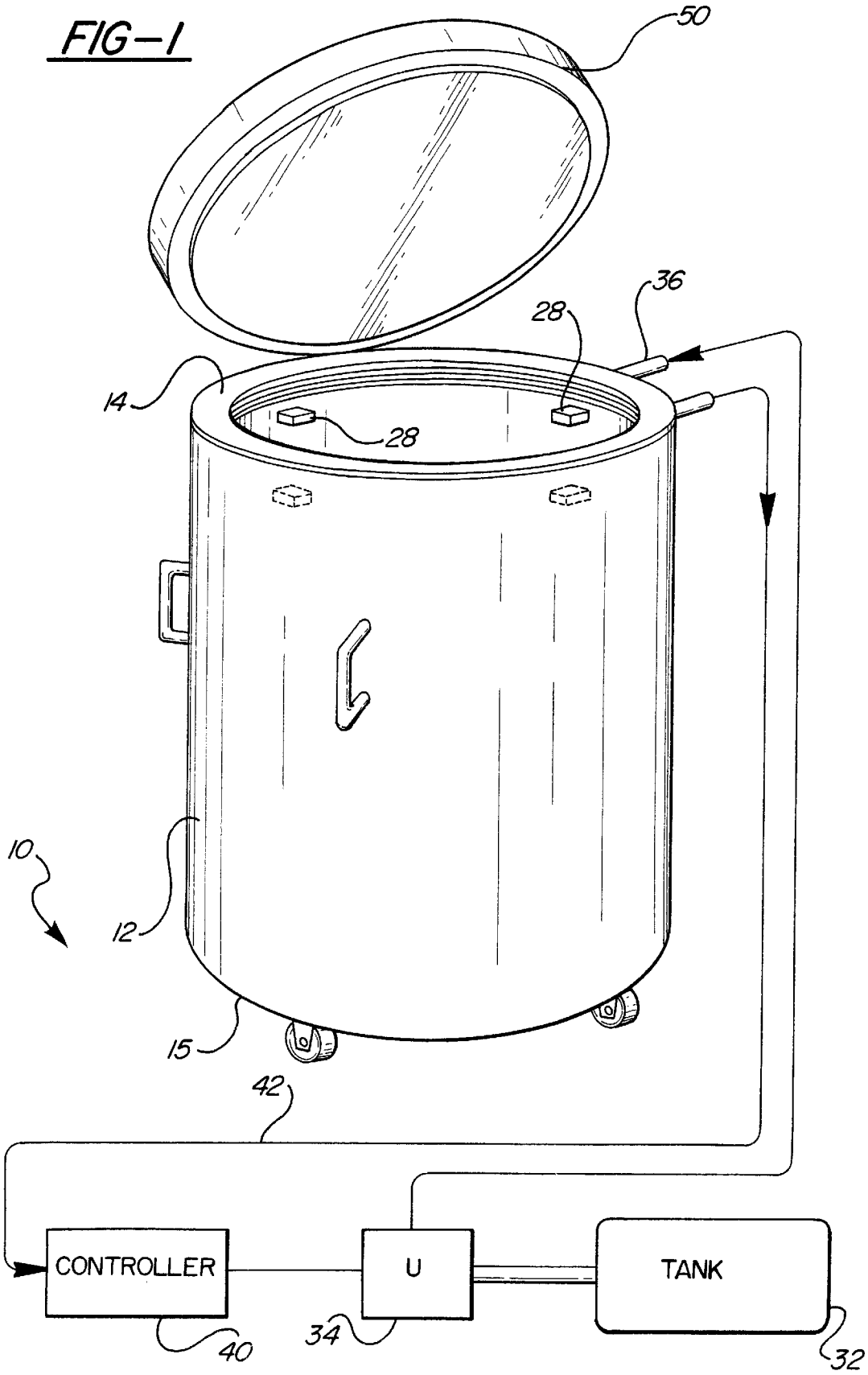
FIG. 1 is a perspective view illustrating a preferred embodiment of the cryogenic device of the present invention.

With reference first to FIG. 1, a preferred embodiment of the cryogenic storage device 10 of the present invention is there shown and comprises a tank 12 which is generally cylindrical in shape. The tank 12 includes an open top 14 and a closed bottom 15.

Figure 2:
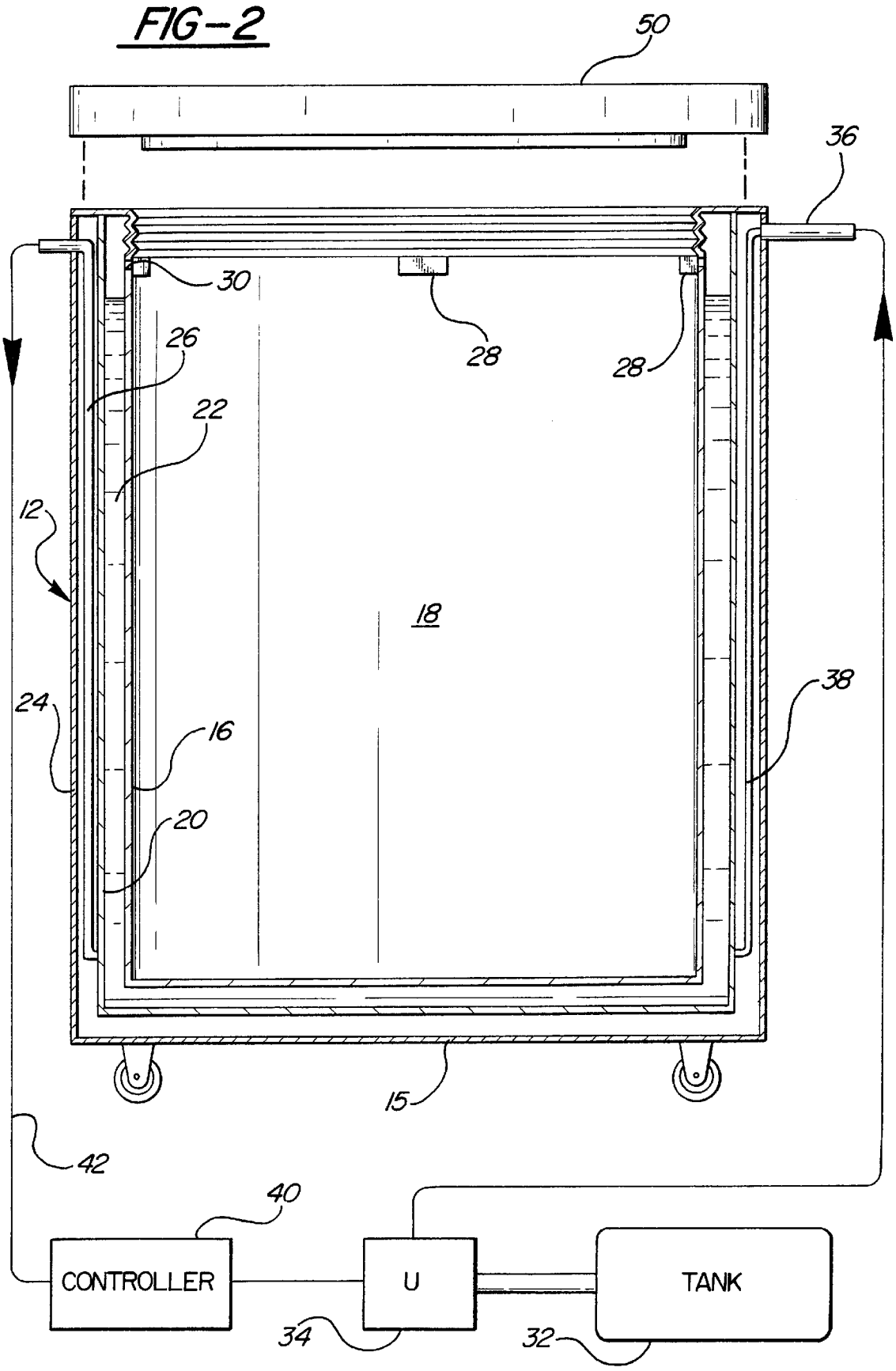
FIG. 2 is a longitudinal sectional view of a portion of the preferred embodiment of the present invention.

As best shown in FIG. 2, the tank 12 includes an inner wall 16 which defines a generally cylindrical interior chamber 18 adapted to receive biological specimens. Such biological specimens are inserted into and removed from the chamber 18 through the open tank top 14 and are held in conventional cryogenic trays. The specimens are typically frozen prior to their insertion into the chamber 18 although, optionally, the device 10 of the present invention can both freeze and store specimens.

Still referring to FIG. 2, the tank 12 further includes a second wall 20 spaced outwardly from and surrounding the inner wall 16 such that a reservoir 22 is formed between the tank walls 16 and 20. This reservoir 22 extends entirely circumferentially around the sides of the chamber 18 as well as the bottom of the chamber 18.

Still referring to FIG. 2, in the preferred embodiment of the invention, a third or outer wall 24 is optionally provided around the wall 20 such that the outer wall 24 is spaced outwardly from the wall 20 around both its sides and bottom thus forming an insulation space 26 between the walls 24 and 20. This insulation space 26 is preferably maintained in a vacuum thus thermally insulating the outer wall 24 from the reservoir 22. Alternatively, however, the insulation space 26 can be filled with a thermal insulation.

With reference now to FIGS. 1 and 2, a plurality of circumferentially spaced vents 28 are provided around the inner wall 16 adjacent its open top 14 and these vents 28 prohibit excessive pressure buildup in the reservoir 22. Each vent 28, furthermore, includes a fluid passageway 30 (FIG. 2) which fluidly connects the top of the reservoir 22 to the interior chamber 18. Furthermore, the outlet from each vent 30 is preferably directed towards the bottom of the chamber 18 so that any vapor flowing outward through the vents 28 is expelled downwardly toward the bottom of the chamber 18. Alternatively, however, the vents 28 may exhaust exteriorly of the tank 12.

Referring now to FIGS. 1 and 2, a source 32 of liquefied gaseous material, such as liquid nitrogen, is fluidly connected through a valve means 34 to a fill port 36 on the tank 12. As best shown in FIG. 2, this fill port 36 is fluidly connected by a conduit 38 to the reservoir 22 adjacent its bottom.

A valve actuator 40 selectively provides an output signal to the valve means 34 to selectively open the valve means 34 whenever the fluid level in the reservoir 22 is below a predetermined amount and, likewise, to close the valve means 34 whenever the liquid level in the reservoir 22 exceeds a second and higher predetermined level. Thus, by selectively opening and closing the valve means 34 and permitting the liquefied gaseous material to flow from the source 32 and to the reservoir 22, the valve means 34 and its valve controller 40 maintains the liquid level in the reservoir 22 between predetermined maximum and minimum amounts.

Although the controller 40 may use any conventional means to determine the liquid level within the reservoir 22, in the preferred embodiment of the invention, the controller 40 is fluidly connected by a conduit 42 to the top of the reservoir 22 and selectively actuates the valve means 34 as a function of the barometric pressure within the reservoir 22. This barometric pressure varies as a function of the liquid level in the reservoir 22.

With reference to FIG. 1, a lid 50 is preferably disposed across the open top 14 of the tank 12 at all times except when biological specimens are introduced into or removed from the chamber 18. This top 50, in the conventional fashion, does not form an airtight seal between the lid 50 and the top 14 of the tank 12. Rather, the lid 50 allows a continuous flow of vapor from the chamber 18 and exteriorly of the tank 12.

In practice, the reservoir 22 is partially filled from the source 32 while the valve means 34 and its controller 40 periodically refill the reservoir 22 to maintain the liquid level in the reservoir 22 within predetermined threshold amounts so that the liquefied gaseous material in the reservoir 22 cools the interior chamber 18 and any biological specimens contained in the chamber 18. Such periodic refilling is required since vapors from the liquefied gas contained in the reservoir 22 continuously exhausts through the vents 30 and preferably into the chamber 18 thus aiding in cooling not only the chamber 18 but also biological specimens contained within the chamber 18. Furthermore, each time the reservoir 22 is partially refilled from the source 32, the increase of liquid level in the reservoir 22 exhausts vapors through the vents 28 and preferably into the chamber 18.

In practice, it has been found that, assuming that nitrogen is utilized as the liquefied gaseous material, the temperature within the chamber 18 can be maintained not only below −140° C., i.e. the amount required to maintain the viability of biological specimens, but can actually maintain the temperature within the chamber 18 at a temperature of less than −190° C. Furthermore, since only gases contained within the chamber 18 are utilized to cool and maintain cold the biological specimens contained with the chamber 18, cross contamination of the biological specimens is essentially precluded.

Having described my invention, however, many modifications thereto will become apparent to those skilled in the art to which it pertains without deviation from the spirit of the invention as defined by the scope of the appended claims.

I claim:

1. A cryogenic storage device comprising a tank having an open top, a bottom and a wall which define an interior chamber adapted to receive biological specimens, a fluid reservoir disposed around an outer surface of said wall and said bottom, an upper end of said reservoir terminating at said open top of said tank, said reservoir adapted to receive a liquefied gaseous material, a source of liquefied gaseous material, means for selectively fluidly connecting said source of liquefied gaseous material to said reservoir so that liquefied gaseous material flows from said source and substantially fills said reservoir wherein thermal conduction through said wall cools said specimens in said tank chamber.

2. The invention as defined in claim 1 and further comprising at least one vent fluidly connecting said reservoir to said interior chamber.

3. The invention as defined in claim 1 and comprising a second wall spaced from and surrounding said first mentioned wall, said reservoir being formed between said walls.

4. The invention as defined in claim 3 and comprising a third wall spaced from and surrounding said second wall and forming an annular chamber therebetween, and thermal insulation disposed in said annular chamber.

5. The invention as defined in claim 4 wherein each of said walls is cylindrical in shape and closed at a bottom end, said walls being coaxial with respect to each other.

6. The invention as defined in claim 1 wherein said at least one vent comprises a plurality of circumferentially spaced vents around an interior surface of said wall.

7. The invention as defined in claim 1 wherein said liquid gaseous material comprises liquid nitrogen.

8. The invention as defined in claim 1 and comprising a lid movable between an open and closed position, wherein in said closed position, said lid overlies and covers said open top of said tank.

9. The invention as defined in claim 1 wherein said selective connecting means comprises a valve fluidly connected in series between said source and said reservoir, means for measuring the level of liquid gaseous material in said reservoir, and means for selectively opening and closing said valve to maintain the level of liquid gaseous material in said reservoir within predefined limits.

10. The invention as defined in claim 9 wherein said measuring means comprises means for measuring barometric pressure in said reservoir above said level of liquid in said reservoir.

* * * * *